US007198843B2

(12) United States Patent
Kim et al.

(10) Patent No.: US 7,198,843 B2
(45) Date of Patent: Apr. 3, 2007

(54) HIGH STRENGTH LOW SHRINKAGE POLYESTER DRAWN YARN, AND A PROCESS OF PREPARING FOR THE SAME

(75) Inventors: Yun-Jo Kim, Kyungsangbuk-do (KR); Su-Jin Lee, Kyungsangbuk-do (KR)

(73) Assignee: Kolon Industries, Inc., Kwacheon (KR)

( * ) Notice: Subject to any disclaimer, the term of this patent is extended or adjusted under 35 U.S.C. 154(b) by 0 days.

(21) Appl. No.: 10/522,247

(22) PCT Filed: Jul. 26, 2003

(86) PCT No.: PCT/KR03/01501

§ 371 (c)(1),
(2), (4) Date: Sep. 23, 2005

(87) PCT Pub. No.: WO2004/011702

PCT Pub. Date: Feb. 5, 2004

(65) Prior Publication Data

US 2006/0145391 A1 Jul. 6, 2006

(30) Foreign Application Priority Data

Jul. 26, 2002 (KR) ..... 10-2002-0044170
Jul. 26, 2002 (KR) ..... 10-2002-0044173

(51) Int. Cl.
*D02G 3/00* (2006.01)
*D01F 6/00* (2006.01)
*B32B 22/34* (2006.01)

(52) U.S. Cl. ..... 428/364; 428/395

(58) Field of Classification Search ..... 428/364, 428/395
See application file for complete search history.

(56) References Cited

U.S. PATENT DOCUMENTS 4,690,866 A * 9/1987 Kumakawa et al. ..... 428/364
5,106,685 A 4/1992 Speaker
5,472,781 A * 12/1995 Kim et al. ..... 428/364
5,658,665 A * 8/1997 Kim et al. ..... 428/395
RE36,698 E * 5/2000 Kim et al. ..... 428/364

* cited by examiner

*Primary Examiner*—N. Edwards
(74) *Attorney, Agent, or Firm*—Birch, Stewart, Kolasch & Birch, LLP

(57) ABSTRACT

The present invention discloses a high strength low shrinkage polyester drawn yarn used as industrial yarns and a process or producing the same. The strength low shrinkage polyester drawn yarn has a thermal relaxation stress change ratio of 5 to 100% and a thermal relaxation stress area ratio of 50 to 140% on a thermal relaxation and shrinkage stress curve with a final temperature set to 170% C. The process for producing a high strength low shrinkage polyester drawn yam by a direct spin draw (DSD) process in which a quenching delay region I is mounted, wherein the high strength low shrinkage polyester drawn yarn is produced in such methods that a spinning oil is attached to the yarn being spun with an oiling apparatus 8 mounted at the position 500 to 1,500 mm below from the lower bottom surface of the insulating board 3, the relaxation stress of the yarn is controlled with one or tow tension guides 9 mounted between Godet rollers of a relaxation region III, or both oiling apparatus 8 and tension guides 9 are mounted.

15 Claims, 6 Drawing Sheets

HIGH STRENGTH LOW SHRINKAGE POLYESTER DRAWN YARN, AND A PROCESS OF PREPARING FOR THE SAME

TECHNICAL FIELD

The present invention relates to a high strength low shrinkage polyester drawn yarn which is used for the production of seat belts, webbings, tarpaulins, advertisement sign posts and so on and a process for producing the same. More particularly, the present invention relates to a high strength low shrinkage polyester drawn yarn which minimizes a form change due to a heat treatment temperature and tension to be applied to an drawn yarn in an after treatment process, that is, which has a superior form stability, and a process for producing the same.

BACKGROUND ART

Generally, polyester drawn yarns used as industrial yarns are produced by a spinning and drawing process in which a quenching delay region I is mounted.

As a concrete conventional technique, as shown in FIG. 1, there has been used a method that improves drawing property by suppressing the orientation property of undrawn yarns, in which a quenching delay region I having a vertical array of a hood heater 2 and an insulating board 3 is mounted between a spinneret 1 and a quenching chamber 4.

In the above-stated conventional technique, a melt polymer extruded from a spinneret 1 is sequentially passed through a high temperature hood heater 2 and an insulating board 3 for monomer absorption and then solidified in a quenching chamber 4 that is mostly an open type, thereby preparing an undrawn yarn.

Then, a spinning oil is fed to the undrawn yarn and drawn with high drawing rate, thereby preparing a drawn yarn.

However, such a conventional method was problematic in that, if a spinning speed increases, a degree of orientation of the undrawn yarn increases, a solidification point is lowered, quenching is carried out non-uniformly and thus the uniformity between undrawn filaments are degraded.

With this degradation of the uniformity between undrawn filaments, the drawing property in a drawing process becomes poor and results in the generation of noils to the drawn yarn and the degradation of quality.

Hence, in the conventional method, there is a limit to increase a spinning speed to more than a predetermined level, and accordingly there is also a limit to improve productivity.

On the other hand, in a polyester drawn yarn produced by the conventional method, a thermal relaxation stress change ratio and thermal relaxation stress area ratio on thermal relaxation and shrinkage stress curves are too large, thus the form of the polyester drawn yarn is easily changed by a heat and tension applied in an after-processing process.

In this way, in the event that the low-shrinkage polyester yarn has a reduced form stability against heat, there occurs a phenomenon that (hereinafter, referred to as a "wrinkle phenomenon") a wrinkle is shown on a product in an after-treatment process for coating polyvinyl chloride (PVC) and this deteriorates the quality of the product.

It is an object of the present invention to provide a high strength low shrinkage polyester drawn yarn which is useful as industrial yarns such as seat belts, webbings, tarpaulins and so on because it shows superior form stability in an after-treatment process.

It is another object of the present invention to provide a process for producing a high strength low shrinkage polyester drawn yarn which can improve form stability against heat and tension, drawing properties and productivity by uniformly managing the solidification point of melt polymers even upon an increase of a spinning speed, uniformly managing a yarn tension during relaxing or making both solidification point and yarn tension during relaxing uniform.

DISCLOSURE OF INVENTION

To achieve the above objects, there is provided a high strength low shrinkage polyester drawn yarn according to the present invention, which is prepared by melting and extruding a solid state polymerization chip of polyethylene terephthalate at a spinning temperature of 273 to 295° C. and drawing the melt and extruded polymer, wherein the high strength low shrinkage polyester drawn yarn has a thermal relaxation stress change ratio of 5 to 100% and a thermal relaxation stress area ratio of 50 to 140% on a thermal relaxation and shrinkage stress curve with a final temperature set to 170° C.

Additionally, there is provided a process for producing a high strength low shrinkage polyester drawn yarn according to the present invention by a direct spin draw process in which a quenching delay region I having a vertical array of a hood heater 2 and an insulating board 3 is mounted between a spinneret 1 and a quenching chamber 4, wherein the high strength low shrinkage polyester drawn yarn is produced in such methods that a spinning oil is attached to the yarn being spun with an oiling apparatus 8 mounted at the position 500 to 1,500 mm below from the lower bottom surface of the insulating board 3, the relaxation stress of the yarn is controlled with one or two tension guides 9 mounted between Godet rollers of a relaxation region III, or both oiling apparatus 8 and tension guides 9 are mounted.

However, the high strength low shrinkage polyester drawn yarn according to the present invention is not produced only by the above-described production methods. Thus, the above methods do not limit the scope of the high strength low shrinkage polyester drawn yarn according to the present invention.

Hereinafter, the present invention will be described in detail.

Firstly, a polyester drawn yarn of this invention is excellent in form stability in an after-treatment process, since it has a low thermal relaxation stress change ratio of 5 to 100% and a low thermal relaxation stress area ratio of 50 to 140%, respectively, on thermal relaxation and shrinkage stress curves (final temperature: 170° C.), which are measured in the method to be explained below.

Specifically, as described above, the polyester drawn yarn of this invention can minimize a form change caused by heat and tension applied in the after-treatment process since it has a low change rate of a shrinkage stress according to a change of heat or tension.

In a case that the thermal relaxation stress change ratio and the thermal relaxation stress area ratio are not in the above-mentioned range, the form stability of the polyester drawn yarn again heat and tension is lowered, which is not preferable.

Preferably, the polyester drawn yarn of this invention has a thermal stress of 0.015 to 0.065 g/d under the measuring condition of 170° C.×initial load of 0.11 g/d, a thermal stress of 0.003 to 0.015 g/d measured under an initial load of 0.01 g/d at 170° C., and an average value of a shrinkage stress of 0.02 to 0.10 g/d at 170° C.

Preferably, the polyester drawn yarn of this invention has a thermal stress of 0.015 to 0.065 g/d under the measuring condition of 150° C.×initial load of 0.11 g/d, a thermal stress of 0.003 to 0.015 g/d measured under an initial load of 0.01 g/d at 150° C., and an average value of a shrinkage stress of 0.02 to 0.10 g/d at 150° C.

Preferably, the polyester drawn yarn of this invention has a birefringence (Δn) of 0.1800 to 0.2200, a cystallinity(Xc) of 44.0 to 55.0%, an amorphous orientation degree (fa) of 0.45 to 0.85 and a crystal orientation degree (fc) of 0.905 to 0.945.

Preferably, the polyester drawn yarn of this invention has a shrinkage of 0.10 to 1.60% under an initial load of 0.01 g/d under the measuring condition of 170° C.×2 minutes and a shrinkage of 0 to −1.5% under an initial load of 0.10 g/d under the measuring condition of 170° C.×2 minutes. As a result, the polyester drawn yarn of this invention has a high strength and a low shrinkage.

In addition, the polyester drawn yarn of this invention has a superior form stability against heat and tension applied in an after-process and when used, so it exhibits a very small shrinkage deviation upon receiving an additional thermal stress. Due to this, upon making a tarpaulin coated with polyvinyl chloride from the polyester drawn yarn of this invention, a wrinkle phenomenon can be prevented.

In the present invention, the physical properties of the yarn were measured by the following method.

Shrinkage(%)

A yarn shrinkage is measured by a Testrite MK-V instrument of Testrite Co. under the measuring condition of 170° C.×2 minutes with a certain tension (0.01 g/d or 0.10 g/d).

Spinning Stress(g)

This is measured on the top end of a first Godet roller 6*a* using a tension-meter.

$$\text{Spinning stress } (g/d) = \frac{\text{spinning tension } (g)}{\text{final drawn yarn fineness}}$$

Thermal Stress(g/d)

This is measured using a thermal stress measurement instrument (Model: KE-2) manufactured by Kanebo Engineering Co. A heating rate is set to 2.5° C./sec. A sample is prepared in the form of a 10 cm loop by utilizing a sampler of KE-2 and a method of knotting the sample (KE-2 Service Manual). An initial load of 20 g(0.01 g/d) and 220 g(0.11 g/d) are applied.

$$\text{Thermal Stress } (g/d) = \frac{\text{thermal stress measured value } (g)}{\text{measured yarn fineness} \times 2}$$

A thermal stress measured value is the average of three measured values.

Thermal Relaxation Stress(g/d)

After heating the sample up to a final temperature (170° C.) set in the above thermal stress measurement method, a thermal relaxation stress is measured while rapidly cooling the sample down to 30 to 40° C. using air.

Thermal Relaxation Stress Change Ratio(%) and Thermal Relaxation Stress Area Ratio(%)

A stress change according to a temperature change is measured by the above-mentioned method of measuring thermal relaxation stress and thermal stress, and graphed to draw up a thermal relaxation and shrinkage stress curve with a final temperature set to 170° C.

A thermal relaxation stress change ratio(%) is calculated by substituting a maximum thermal stress(Fmax) and minimum thermal stress(Fm) obtained from the thermal relaxation and shrinkage stress curve into the following equation (I):

$$\text{Thermal Relaxation Stress Change Ratio } (\%) = \left|\frac{F_{\max} - F_1}{F_1 - F_{\min}}\right| \times 100 \quad \text{(I)}$$

Wherein $F_{max}$ represents a maximum thermal stress, $F_{min}$ represents a minimum thermal stress and F1 represents an initial stress.

Meanwhile, a relaxation stress area B and a thermal stress area A are cut from the thermal relaxation and shrinkage stress curve to measure the weight of each portion. Then, the thermal relaxation stress area ratio(%) is calculated by substituting the measured values to the following equation (II):

$$\text{Thermal Relaxation Stress Area Ratio } (\%) = \frac{\text{weight of relaxation stress area } (B)}{\text{weight of thermal stress area } (A)} \times 100 \quad \text{(II)}$$

Average Value of Shrinkage Stress

A maximum shrinkage stress and a minimum shrinkage stress are measured using FTA-500 and then the average value thereof is obtained. The drawing ratio is set to 100% and the chamber temperature is set to 150° C. or 170° C. The chamber detention time is set to 9.6 seconds.

Birefringence(Δn)

This is measured with an interference microscope (Model: JENAPOLUINTERPHAKO manufactured by Carl-Zeiss Yena Co., Germany). The birefringence is obtained by the following equation:

$$\text{Birefringence } (\Delta n) = \frac{R + S}{1{,}000 \times D}$$

Wherein R represents compensator retardation, S represents retardation of quartz shim, and D represents fiber diameter. The unit of R and S is nm and the unit of D is μm.

Strength/Elongation

This is measured ten times with a tension tester of INSTRONG (sample length: 250 mm, tension speed: 300 mm/min) to obtain the average value.

Density(ρ)

A density is measured by putting a drawn yarn into a densimeter (Model SS, a product of Shibayama, Japan) composed of a mixed solution consisting of normal heptane and carbon tetrachloride and leaving it as it is at 25° C. for one day.

Crystallinity[Xc(%)]

Based on the above density(ρ), the crystallinity is obtained using the theoretical density of perfect crystal region ($\rho_c$=1.457 g/cm$^3$) of polyester and the density of a perfect amorphous region ($\rho_a$=1.336 g/cm$^3$) thereof by the following equation:

$$\text{Crystallinity } [Xc(\%)] = \frac{\rho - \rho_a}{\rho_c - \rho_a} \times 100$$

Crystal Orientation Degree(Fc)

The crystal orientation degree(Fc) of a drawn yarn is calculated by measuring the FWHM(full width at half-maximum intensity) of a peak representing the characteristics of crystal orientation by performing an azimuthal scanning on the surfaces (010) facet and (100) facet of crystal using a X-ray diffractometer. The crystal orientation degree is calculated based on the FWHM by the following equation:

$$\text{Density } (\rho) = \sin^{-1}\left(\cos\frac{2\theta}{2} \times \sin\frac{FWHM}{2}\right)$$

$$\text{Crystal Orientation Degree } (Fc) = \frac{90 - \text{density } (\rho)}{90}$$

Amorphous Orientation

The amorphous orientation degree(Fa) of an drawn yarn is obtained by substituting the above-described crystallinity (Xc), crystal orientation degree(Fc) and birefringence(An) into the following equation:

$$\text{Amorphous Orientation Degree } (Fa) = \frac{\Delta n - Xc \times Fc \times \Delta n_c}{(1 - Xc) \times \Delta n_a}$$

wherein $\Delta n_c$ represents intrinsic birefringence (0.29) of crystal and $\Delta n_a$ represents intrinsic birefringence (0.20) of amorphous.

Next, a process for producing a high strength low shrinkage polyester drawn yarn according to the present invention will be described in detail.

However, the high strength low shrinkage polyester drawn yarn of this invention is not produced only by the production methods to be explained below. Hence, the methods to be explained below doe not limit the scope of the present invention.

First, a solid state polymerization chip of polyester having an intrinsic viscosity of 0.78 to 1.00 is extruded through a spinneret 1 at a spinning temperature of 273 to 295° C. Then, the extruded melt polymer is passed through a quenching delay region I having a vertical array of a hood heater 2 and an insulating board 3 to delay the quenching of the melt polymer.

Preferably, the temperature of the hood heater 2 is set to 250 to 350° C. and the length thereof is set to 200 to 400 mm in order to make yarn productivity good by smooth drawing and prevent the decomposition of the melt polymer to thus improve yarn strength.

Preferably, the length of the insulating board 3 is set to 60 to 300 mm in order to improve a quenching delay effect and prevent a defective winding due to a rapid reduction of spinning tension.

Preferably, the yarn detention time in the quenching delay region I is controlled to 0.02 to 0.08 seconds in order to make the quenching delay effect and the drawing properties good and prevent noils and yarn cutting to thus improve operatability.

Continuously, it is preferable to solidify the melt polymer passed through the quenching delay region I in the quenching chamber 4 and simultaneously adhere a spinning oil to the melt polymer by an oiling apparatus 8 or adhere a spinning oil to a solidified undrawn yarn by an oiling apparatus 8 right after solidifying the melt polymer in the quenching chamber 4, so as to uniformly manage the solidification point and physical properties of the melt polymer or monofilaments of the undrawn yarn.

The oiling apparatus 8 is mounted at the position 500 to 1,500 mm below from the lower bottom surface of the insulating board 3. If the distance from the insulating board 3 is less than 500 mm, the spinning oil may be denatured or the melt polymer may be rapidly quenched and thus internal and external layers of the undrawn yarn becomes non-uniform, thereby making winding difficult. On the other hand, if the distance from the insulating board 3 is more than 1,500 mm, the quenching delay effect may be small.

More preferably, the spinning speed is controlled to 500 to 900 m/min and the spinning tension is controlled to below 0.3 g/d in order to improve operatability and yarn properties.

Continually, the undrawn yarn solidified and attached with the spinning oil as explained above is drawn and heat-treated at a space between a first Godet roller 6*a* and a fourth Godet roller 6*d* which is a stretching region II.

For maintaining a yarn path and for a secondary oiling, an oiling apparatus 5 may be mounted on top of the first Godet roller 6*a*.

Preferably, the drawing ratio in the stretching region II is controlled to five to six times in order to improve yarn tension and prevent noil generation. Preferably, the heat treatment temperature is controlled to 210 to 250° C. in order to improve heat resistance, form stability and operatability.

Continually, the drawn yarn passed through the stretching region II is relaxed in a relaxation region III between the fourth Godet roller 6*d* and a sixth Godet roller 6*f* at a relaxation temperature of 150 to 220° C. and with a relaxation ratio of 5 to 12% to thus prepare a high strength low shrinkage polyester drawn yarn. It is preferable that the relaxation temperature and the relaxation ratio are in the above-mentioned ranges in order to easily lower the relaxation stress of the yarn to thereby reveal the low shrinkage property and improve yarn productivity.

More preferably, one or two tension guides 9 are mounted between the Godet rollers of the relaxation region III to control the relaxation stress of the yarn.

The process of this invention enables a high ratio drawing because the orientation of the undrawn yarn can be maintained low even upon high spinning speed.

Further, the process of this invention can manage the physical properties of the drawn yarn uniformly and improve the quality of the drawn yarn because the physical properties of the undrawn yarn can be managed uniformly.

In the present invention, as shown in FIG. 3, the oiling apparatus 8 is mounted at the position 500 to 1,500 mm below from the lower bottom surface of the insulating board 3 to attach a spinning oil to the yarn being spun. But, the tension guide 9 between the Godet rollers of the relaxation region III may not be mounted and used.

Additionally, in the present invention, as shown in FIG. 4, the one or two tension guides 9 is mounted between the Godet rollers of the relaxation region III to control the relaxation stress of the yarn. But, the oiling apparatus 8 may not be mounted on the lower end of the insulating board 3.

Additionally, in the present invention, as shown in FIG. 2, the oiling apparatus 8 may be mounted on the lower end of the insulating board 3 to attach a spinning oil to the yarn being spun and, at the same time, the one or two tension guides 9 may be mounted and used between the Godet rollers of the relaxation region III.

The above-described process of this invention can reduce a wrinkle phenomenon occurring upon coating polyvinyl chloride (PVC) on a tarpaulin by improving the form stability of the drawn yarn against heat or tension.

The present invention also includes a fabric and a polyvinyl chloride (PVC) coating fabric made of the above-described high strength low shrinkage polyester drawn yarn.

BRIEF DESCRIPTION OF THE DRAWINGS

These and other features, aspects, and advantages of preferred embodiments of the present invention will be more fully described in the following detailed description, taken accompanying drawings. In the drawings.

EXPLANATION OF REFERENCE NUMERALS FOR ESSENTIAL PARTS IN THE DRAWINGS

Figure 1:
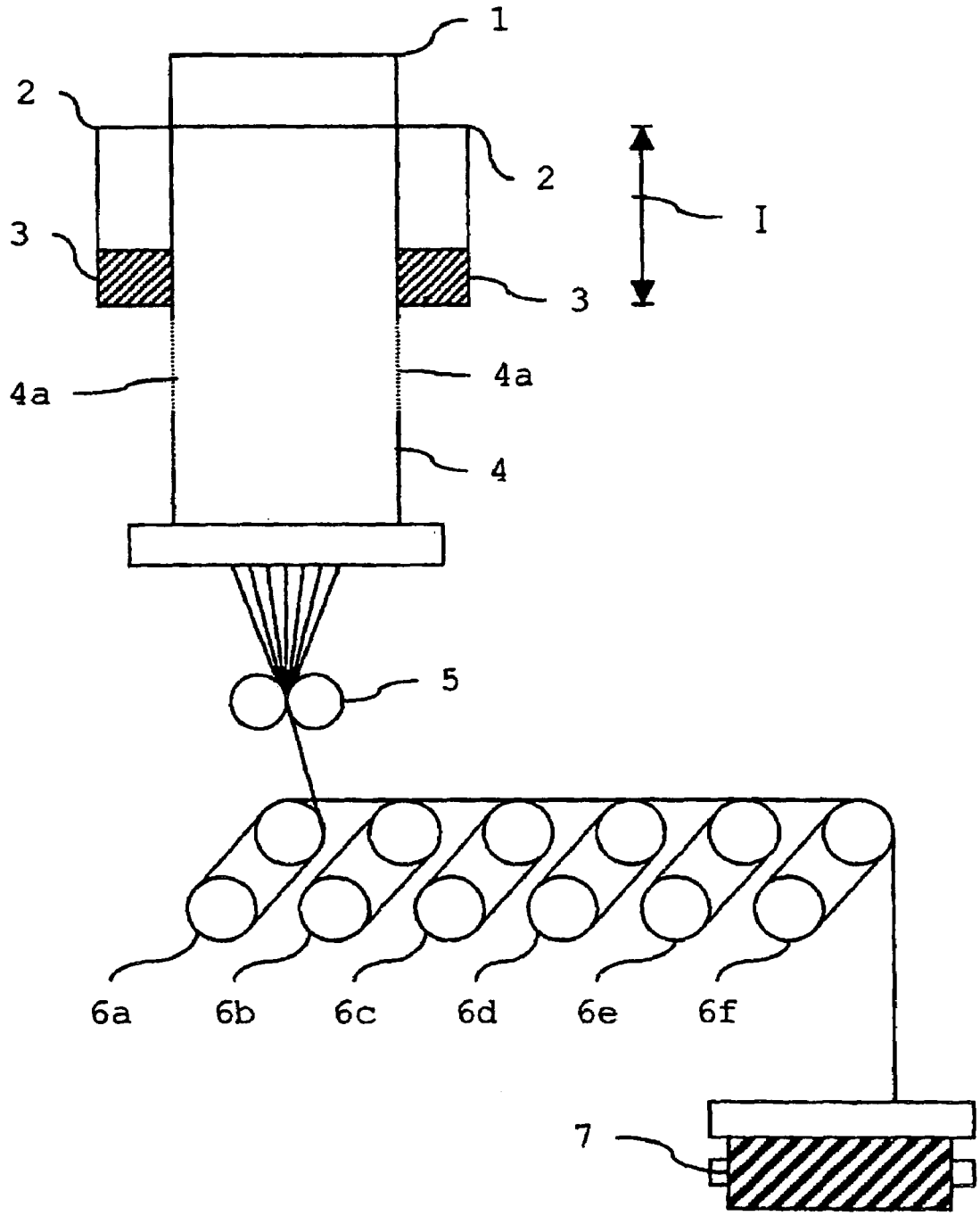
FIG. 1 is a schematic view showing a process of conventional technique for producing a high strength low shrinkage polyester drawn yarn.
Figure 2:
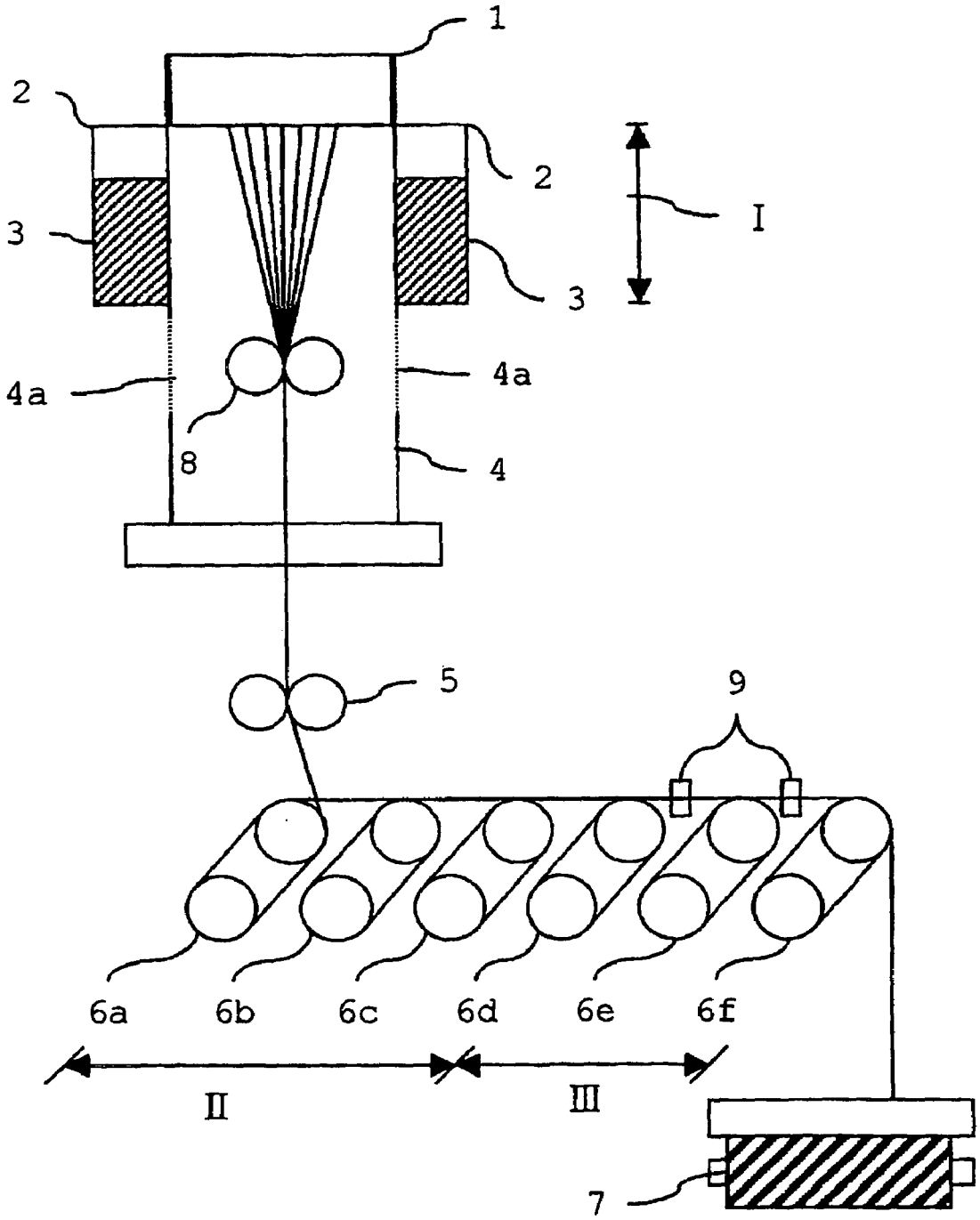
FIGS. 2 to 4 are schematic view showing a process of the present invention for producing a high strength low shrinkage polyester drawn yarn.
Figure 3:
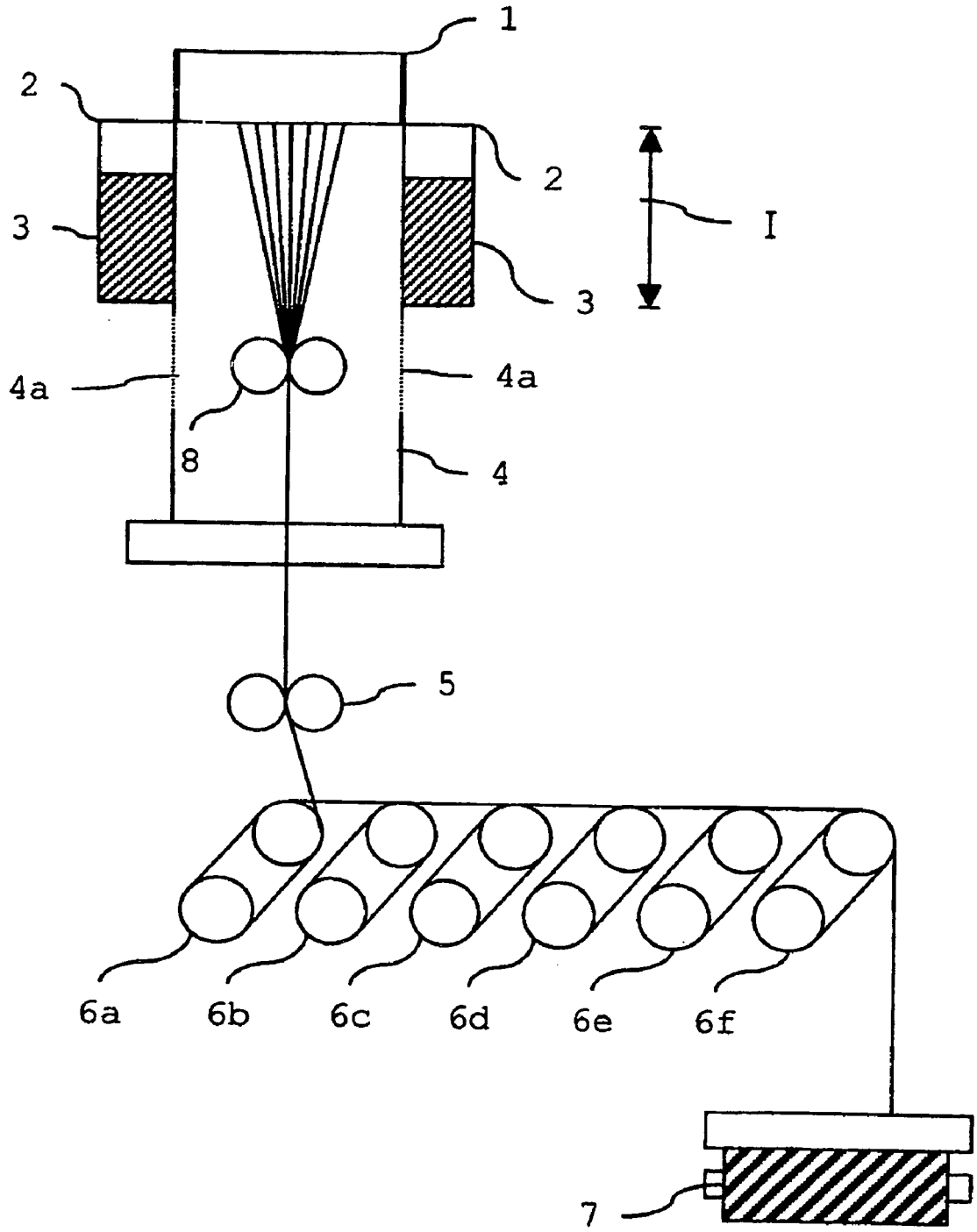
Figure 4:
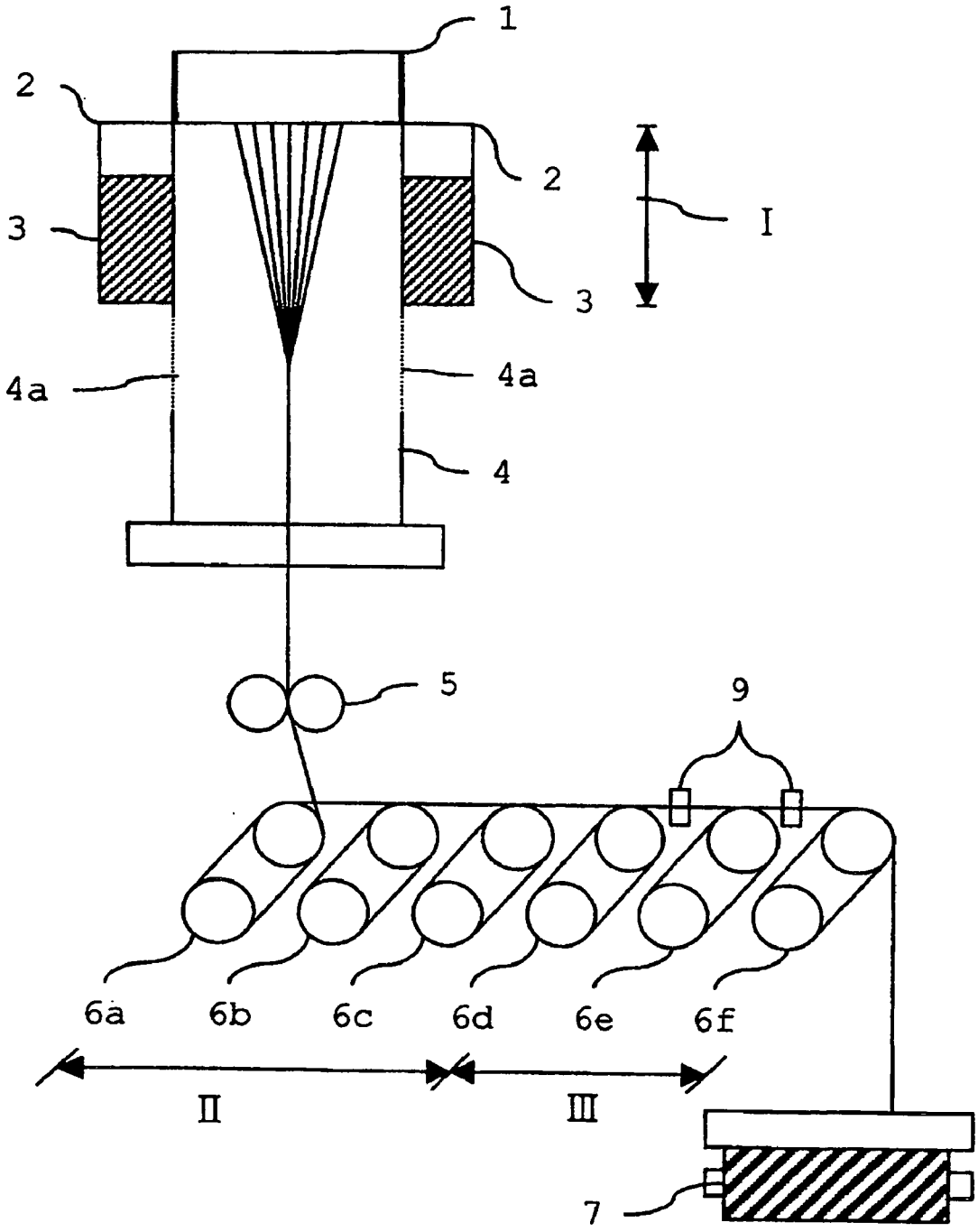
Figure 5:
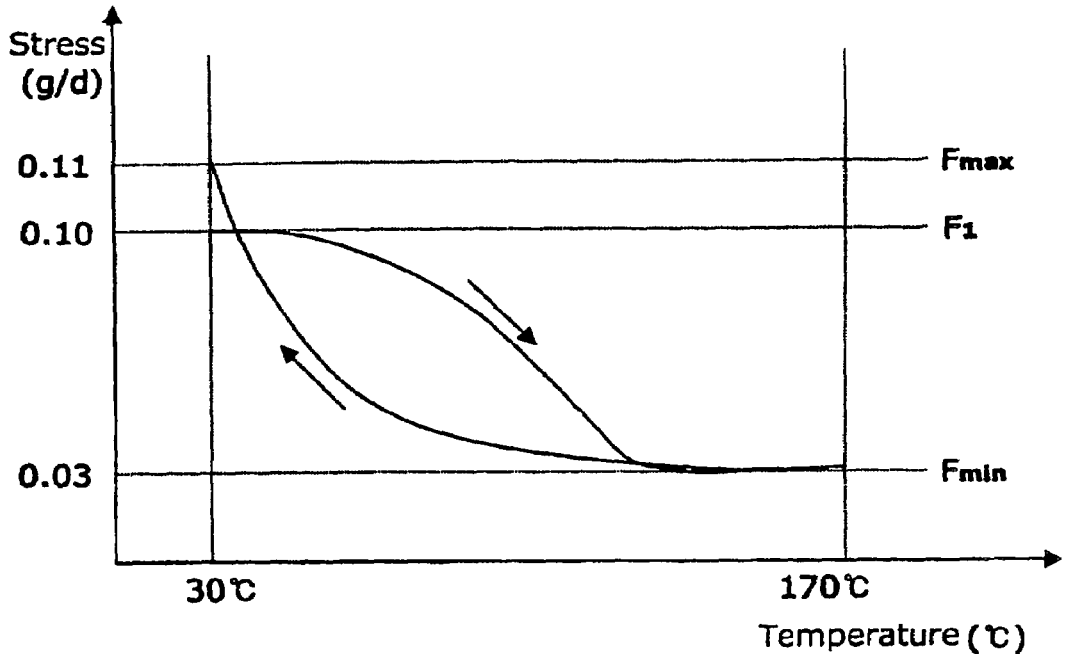
FIG. 5 is a thermal relaxation and shrinkage stress curve of the high strength low shrinkage polyester drawn yarn according to the present invention.
Figure 6:
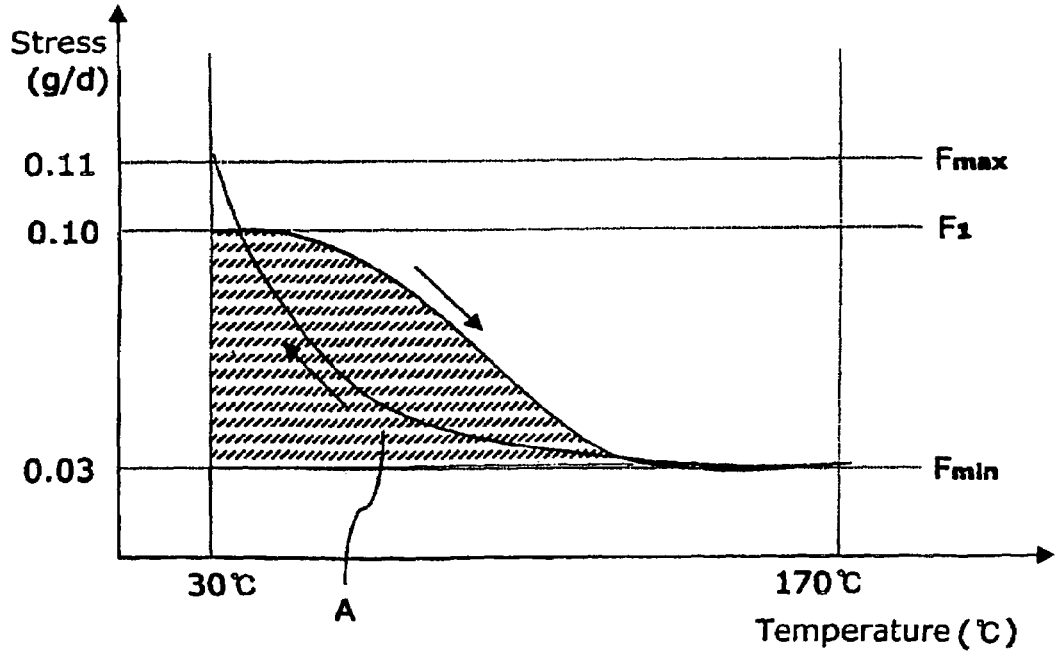
FIG. 6 is the thermal relaxation and shrinkage stress curve of FIG. 5 in which a thermal stress area (A) is indicated in oblique line.
Figure 7:
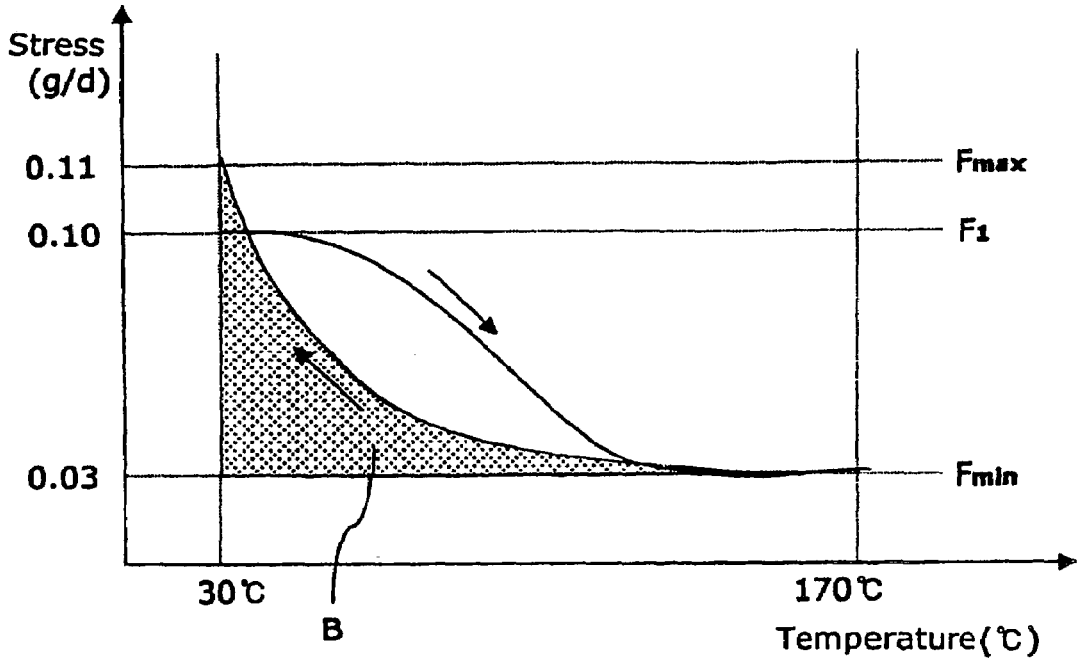
FIG. 7 is the thermal relaxation and shrinkage stress curve of FIG. 5 in which a relaxation stress area (B) is indicated in oblique line.

1: spinneret
2: hood heater
3: insulating board
4: quenching chamber
4*a*: quenching screen
5, 8: oiling apparatus
6*a* to 6*f*: first to sixth Godet rollers
7: winder
9: tension guide
I: quenching delay region
II: stretching region
III: relaxation region
A: thermal stress area
B: relaxation stress area
$F_1$: initial stress
$F_{max}$: maximum stress
$F_{min}$: minimum stress

BEST MODES FOR CARRYING OUT THE INVENTION

Hereinafter, the present invention will be described in more detail by the following examples, but not limited thereto.

EXAMPLE 1

A solid state polymerization chip of polyethylene terephthalate having a intrinsic viscosity of 0.79 is extruded through a spinneret 1 at a spinning temperature of 273° C. Then, the extruded melt polymer is quenched delayly as being passed through a quenching delay region I consisting of a hood heater 2 with a 300 mm length and a 300° C. temperature and an insulating board with a 60 mm length.

The detention time of the melt polymer in the quenching delay region is 0.04 seconds and the spinning speed is 600 m/min. Continuously, the melt polymer is solidified in a quenching chamber 4 with a 1,500 mm length and at the same time a spinning oil is fed by an oiling apparatus 8 mounted at the position 600 mm below from the insulating board, thereby preparing an undrawn yarn. Next, the undrawn yarn is drawn 5.65 times and heat-treated at 240° C. while being passed through first Godet roller 6*a* to fourth Godet roller 6*d*. Next, the drawn yarn is relaxed at a relaxation ratio of 11% and at a relaxation temperature of 170° C. while being passed through the forth Godet roller 6*d* to sixth Godet roller 6*f* having tension guides 9 mounted therebetween. Then, the relaxed yarn is wound to thus produce a drawn polyester yarn of 1,000 deniers. The results of evaluation of various physical properties of the produced polyester drawn yarn are as shown in Table 2.

EXAMPLES 2~EXAMPLES 7

A polyester drawn yarn is produced in the same process and condition as in Example 1 except that the production condition is changed as in Table 1. The results of evaluation of various physical properties of the produced polyester drawn yarn are as shown in Table 2.

TABLE 1

| | Production Condition | | | | | | |
|---|---|---|---|---|---|---|---|
| | Examples | | | | | | |
| classification | 1 | 2 | 3 | 4 | 5 | 6 | 7 |
| Intrinsic viscosity of chip | 0.79 | 0.83 | 0.85 | 0.85 | 0.85 | 0.85 | 0.95 |
| Spinning temperature(° C.) | 273 | 278 | 280 | 280 | 285 | 280 | 292 |
| Hood heater temperature(° C.) | 300 | 300 | 300 | 350 | 250 | 300 | 300 |
| Length(mm) | 300 | 300 | 300 | 200 | 400 | 300 | 300 |
| Length of insulating board(mm) | 60 | 300 | 100 | 100 | 100 | 200 | 200 |
| Polymer detention time in quenching delay region (I) (min) | 0.04 | 0.06 | 0.04 | 0.02 | 0.06 | 0.05 | 0.05 |
| Spinning speed(m/min) | 600 | 600 | 600 | 800 | 500 | 600 | 600 |
| Distance(mm) between insulating board and oiling apparatus | 600 | 600 | 600 | 800 | 550 | 550 | 700 |
| Drawing ratio (time) | 5.65 | 5.50 | 5.50 | 5.50 | 5.50 | 5.35 | 5.35 |
| Heat treatment temperature(° C.) | 240 | 240 | 240 | 240 | 240 | 220 | 220 |
| Relaxation ratio(%) | 11.0 | 10.0 | 10.0 | 6.0 | 8.5 | 10.0 | 10.0 |
| Relaxation temperature(° C.) | 170 | 190 | 160 | 220 | 200 | 210 | 210 |

TABLE 2

Results of Evaluation of Physical Properties of Drawn Yarn

| Classification | | Examples 1 | 2 | 3 | 4 | 5 | 6 | 7 |
|---|---|---|---|---|---|---|---|---|
| Spinning tension(g/d) | | 0.12 | 0.11 | 0.15 | 0.22 | 0.12 | 0.13 | 0.17 |
| Shrinkage(%) measured under initial load of 0.01 g/d | | 1.0 | 0.3 | 1.3 | 1.4 | 1.1 | 1.0 | 1.3 |
| Shrinkage(%) measured under initial load of 0.10 g/d | | −0.9 | −1.4 | −0.5 | −0.3 | −1.0 | −0.8 | −0.4 |
| Undrawn birefringence | | 0.0023 | 0.0020 | 0.0032 | 0.0039 | 0.0022 | 0.0027 | 0.0035 |
| Drawn yarn | Birefringence Δn | 0.2043 | 0.1860 | 0.1890 | 0.2154 | 0.1870 | 0.1820 | 0.1948 |
| | Crystallinity (Xc) | 50.3 | 53.4 | 52.3 | 49.5 | 50.1 | 47.3 | 44.2 |
| | Crystal orientation degree(fc) | 0.924 | 0.915 | 0.931 | 0.943 | 0.918 | 0.913 | 0.910 |
| | Amorphous orientation degree(fa) | 0.58 | 0.45 | 0.50 | 0.82 | 0.67 | 0.63 | 0.71 |
| Average value of shrinkage stress at 150° C. | | 0.06 | 0.04 | 0.05 | 0.10 | 0.09 | 0.09 | 0.07 |
| Average value of shrinkage stress at 170° C. | | 0.05 | 0.03 | 0.05 | 0.09 | 0.08 | 0.08 | 0.07 |
| Thermal stress(g/d) measured under initial load of 0.01 g/d at 170° C. | | 0.007 | 0.005 | 0.006 | 0.014 | 0.013 | 0.011 | 0.009 |
| Thermal stress(g/d) measured under initial load of 0.01 g/d at 150° C. | | 0.008 | 0.007 | 0.008 | 0.015 | 0.011 | 0.013 | 0.010 |
| Thermal stress(g/d) measured under initial load of 0.11 g/d at 170° C. | | 0.045 | 0.030 | 0.038 | 0.063 | 0.058 | 0.054 | 0.052 |
| Thermal stress(g/d) measured under initial load of 0.11 g/d at 150° C. | | 0.047 | 0.025 | 0.034 | 0.065 | 0.041 | 0.048 | 0.046 |
| Thermal relaxation stress change ratio(%) | | 38 | 10 | 25 | 80 | 50 | 65 | 73 |
| Thermal relaxation stress area ratio(%) | | 105 | 55 | 85 | 140 | 135 | 120 | 135 |

INDUSTRIAL APPLICABILITY

In the present invention, since the solidification point of the melt polymer can be uniformly managed even at a high spinning speed, the productivity is improved.

Further, since the drawing properties are good, the physical properties and quality of the yarn are improved. Furthermore, the high strength low shrinkage polyester drawn yarn of this invention has a low thermal relaxation stress change ratio and a low thermal relaxation stress area ratio, thus the form stability against heat and tension is excellent. Subsequently, the high strength low shrinkage polyester drawn yarn of this invention is very useful as industrial yarns used in the production of seat belt, webbing, etc.

The invention claimed is:

1. A high strength low shrinkage polyester drawn yarn, wherein the high strength low shrinkage polyester drawn yarn has a thermal relaxation stress change ratio of 5 to 100% and a thermal relaxation stress area ratio of 50 to 140% on a thermal relaxation and shrinkage stress curve with a final temperature set to 170° C.

2. The polyester drawn yarn of claim 1, wherein the thermal stress measured under an initial load of 0.11 g/d at 170° C. is 0.015 to 0.065 g/d.

3. The polyester drawn yarn of claim 1, wherein the thermal stress measured under an initial load of 0.01 g/d at 170° C. is 0.003 to 0.015 g/d.

4. The polyester drawn yarn of claim 1, wherein the average value of shrinkage stress measured at 170° C. is 0.02 to 0.10 g/d.

5. The polyester drawn yarn of claim 1, wherein the thermal stress measured under an initial load of 0.11 g/d at 150° C. is 0.015 to 0.065 g/d.

6. The polyester drawn yarn of claim 1, wherein the thermal stress measured under an initial load of 0.01 g/d at 150° C. is 0.003 to 0.015 g/d.

7. The polyester drawn yarn of claim 1, wherein the average shrinkage stress measured at 150° C. is 0.02 to 0.10 g/d.

8. The polyester drawn yarn of claim 1, wherein the birefringence (Δn) of the polyester drawn yarn is 0.1800 to 0.2200.

9. The polyester drawn yarn of claim 1, wherein the crystallinity (Xc) of the polyester drawn yarn is 44.0 to 55.0%.

10. The polyester drawn yarn of claim 1, wherein the amorphous orientation degree (fa) of the polyester drawn yarn is 0.45 to 0.85.

11. The polyester drawn yarn of claim 1, wherein the crystal orientation degree (fc) of the polyester drawn yarn is 0.905 to 0.945.

12. The polyester drawn yarn of claim 1, wherein the shrinkage is 0.10 to 1.60% under an initial load of 0.01 g/d at the measuring condition of 170° C.×2 minutes.

13. The polyester drawn yarn of claim 1, wherein the shrinkage is 0 to −1.5% under an initial load of 0.10 g/d at the measuring condition of 170° C.×2 minutes.

14. A fabric produced by using the high strength low shrinkage polyester drawn yarn of claim 1.

15. A polyvinyl chloride (PVC) coating fabric produced by using the high strength low shrinkage polyester drawn yarn of claim 1.

* * * * *